US007699063B2

(12) United States Patent
Hruby

(10) Patent No.: US 7,699,063 B2
(45) Date of Patent: Apr. 20, 2010

(54) DISPENSER FOR A DRAWER-TYPE DISHWASHER

(75) Inventor: Daniel Hruby, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 1280 days.

(21) Appl. No.: 11/206,217

(22) Filed: Aug. 18, 2005

(65) Prior Publication Data

US 2007/0039634 A1 Feb. 22, 2007

(51) Int. Cl.
*B08B 3/00* (2006.01)

(52) U.S. Cl. ..... 134/99.2; 134/58 D; 134/93; 134/113; 134/200; 222/129

(58) Field of Classification Search ..... 134/25.2, 134/56 R, 93, 200, 25.1, 58 D, 57 D, 56 D, 134/113; 68/17 R; 222/325, 129
See application file for complete search history.

(56) References Cited

U.S. PATENT DOCUMENTS

| | | | | |
|---|---|---|---|---|
| RE24,198 | E | 8/1956 | Sharp et al. | |
| RE25,814 | E | 6/1965 | Buzicky et al. | |
| 4,009,598 | A | 3/1977 | Bernard et al. | |
| 4,149,654 | A * | 4/1979 | Nelson et al. | 222/651 |
| 4,974,750 | A | 12/1990 | Welch | |
| 5,133,487 | A | 7/1992 | Russi | |
| 5,176,297 | A | 1/1993 | Mooney et al. | |
| 5,186,912 | A | 2/1993 | Steindorf et al. | |
| 5,205,304 | A * | 4/1993 | Cooper et al. | 134/99.2 |
| 5,261,432 | A | 11/1993 | Sandrin | |
| 5,603,431 | A | 2/1997 | Tuller | |
| D393,333 | S | 4/1998 | Kibler et al. | |
| 6,058,946 | A | 5/2000 | Bellati et al. | |
| 6,138,693 | A | 10/2000 | Matz | |
| 6,189,551 | B1 | 2/2001 | Sargeant et al. | |
| 6,474,351 | B1 | 11/2002 | Cerruti et al. | |
| 6,622,896 | B2 | 9/2003 | Hegeman et al. | |
| D481,178 | S | 10/2003 | Wendt et al. | |
| 6,659,114 | B2 | 12/2003 | Bigott | |
| 7,047,987 | B2 * | 5/2006 | Cerruti et al. | 134/58 D |
| 2003/0106570 | A1 | 6/2003 | Cerruti | |
| 2003/0188768 | A1 * | 10/2003 | Cerruti et al. | 134/57 D |
| 2004/0069325 | A1 | 4/2004 | Cerruti et al. | |
| 2004/0118434 | A1 | 6/2004 | Virgilio et al. | |
| 2007/0215653 | A1 * | 9/2007 | Marone | 222/651 |

FOREIGN PATENT DOCUMENTS

EP 0719517 A2 * 3/1996

* cited by examiner

*Primary Examiner*—Michael Kornakov
*Assistant Examiner*—Naomi Birbach
(74) *Attorney, Agent, or Firm*—John W. Morrison; Diederiks & Whitelaw PLC

(57) ABSTRACT

A drawer-type dishwasher includes a dispenser mounted to one of front and opposing side walls of a basin. The basin is slidably supported in an outer body of the dishwasher. The dispenser includes a main body portion, first and second reservoirs and an actuator. Each of the first and second reservoirs includes upper and lower openings. The first reservoir includes a cover that selectively closes the upper opening, while the lower opening is opened by the actuator. The second reservoir is provided with first and second lids pivotally mounted to the main body portion. The first lid is opened to allow loading of wash aid, while the second lid is opened during a wash operation to release the wash aid. After the wash operation concludes, the second lid is closed, causing the first lid to open allowing detergent to again be loaded into the second reservoir.

18 Claims, 8 Drawing Sheets

DISPENSER FOR A DRAWER-TYPE DISHWASHER

BACKGROUND OF THE INVENTION

1. Field of the Invention

The present invention pertains to the art of dishwashers and, more particularly, to a dispenser for releasing detergent and/or rinse aid into a wash chamber of a drawer-type dishwasher.

2. Discussion of the Prior Art

In general, dishwashers having one or more pull-out drawers are known in the art. In some cases, the dishwasher will include an upper, pull-out drawer forming a washing chamber for washing smaller objects such as glassware, utensils, small plates and the like, and a lower conventional-type dishwasher. In other cases, the dishwasher will include upper and lower pull-out washing chamber defining drawers, or simply include a single pull-out type washing chamber. Regardless of the design, the dishwasher is typically provided with a dispenser for releasing detergent and/or rinse aid into the washing chamber during a washing operation.

In a conventional dishwasher, a dispenser for detergent and rinse aid will be typically located on a door assembly. At the start of a washing operation, the door assembly is shifted to an open, substantially horizontal position, the dispenser loaded and, after loading dishes, the door assembly is closed and a washing operation is initiated. During the washing operation, a mechanism opens the dispenser to allow detergent to fall into the dishwasher. However, unlike conventional dishwashers, drawer-type dishwashers do not include a door assembly that allows loading of detergent in a horizontal orientation and dispensing in a vertical orientation.

A detergent dispenser for a drawer-type dishwasher is typically mounted to or formed in a front wall of the drawer. One dispenser design includes a pull-out chamber that, once open, is loaded with detergent. With this design, after the dispenser is loaded, the chamber is pivoted back into a receptacle formed in the front wall of the drawer. At a predetermined point of the washing operation, a jet of water is directed into the dispenser from a nozzle formed in the receptacle. The detergent is then washed through an opening formed in a bottom of the receptacle and into the drawer. While effective, this design requires tubing for creating the jet of water to be formed into the drawer during manufacturing, thereby raising the overall cost and complexity of the appliance.

Other designs utilize simple tilt-out chambers that are filled with detergent and later washed out by jets of water or disposable containers that are supported on side walls of the drawers. For instance, a single or multi-use disposable container, coupled to an actuation mechanism, can be used to dispense a prescribed amount of detergent at a predetermined point in the washing operation. Once the container is depleted, a new container must be positioned in the drawer. While this method is also effective, consumers are faced with limited choices. Not all manufacturers of detergent have developed detergent containers of this type.

Regardless of the known prior art, there still exists a need for an effective dispenser for a drawer-type dishwasher. More specifically, there exists a need for a dispenser for releasing detergent and/or rinse aid wherein the dispenser is mounted to a wall of a drawer-type dishwasher wash chamber without requiring special plumbing to wash the detergent into the wash chamber.

SUMMARY OF THE INVENTION

The present invention is directed to a dispenser for a drawer-type dishwasher. The dispenser is mounted to one of front and opposing side walls of a wash tub or basin slidably supported in an outer body of the dishwasher. In accordance with the invention, the dispenser includes a main body portion, a first reservoir, a second reservoir and an actuator for releasing wash aid from respective ones of the first and second reservoirs into the wash tub. The first reservoir includes a first opening for loading wash aid and a second opening for releasing the wash aid. More specifically, the first opening is exposed at a top portion of the reservoir, while the second opening leads to an outlet formed on one of a front section and a bottom section of the main body portion.

The second reservoir includes a first opening exposed at a top portion of the reservoir and a second opening arranged on one of the front section and the bottom section of the main body portion. In accordance with a preferred form of the invention, the second reservoir includes first and second lids that selectively cover the first and second openings respectively. Preferably, the lids are pivotally mounted relative to the main body portion and are shiftable between open and closed positions.

The first lid is shifted to the open position to allow a consumer to load a wash aid, such as detergent, into the second reservoir. Once the detergent is loaded into the reservoir, the first lid is shifted to the closed position. At this point, the wash tub can be shifted into the outer body, and a washing operation initiated. At predetermined times during the washing operation, the actuator releases wash aid from the first reservoir and opens the second lid to release detergent from the second reservoir. At the termination of the wash operation, the second lid can be shifted to the closed position which, in the most preferred form of the invention, causes the first lid to automatically shift to the open position.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
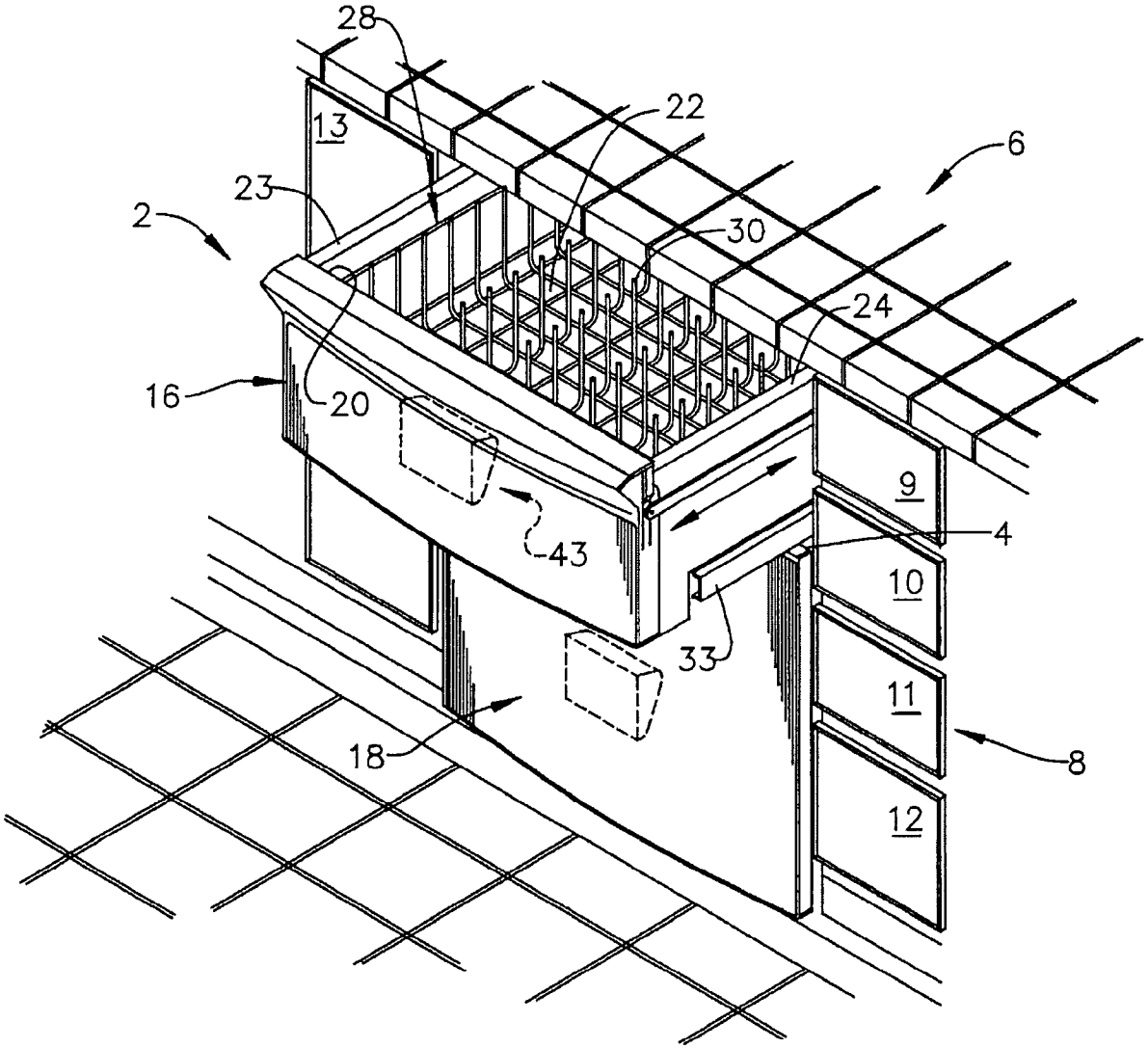
FIG. 1 is an upper right perspective view of a dishwasher incorporating a detergent dispenser constructed in accordance with the present invention.

With initial reference to FIG. 1, a dishwasher constructed in accordance with the present invention is generally indicated at 2. As shown, dishwasher 2 includes an outer body 4 in the form of a support frame arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper washing unit 16 and a lower washing unit 18. Upper and lower washing units 16 and 18 take the form of slide-out drawers capable of operating either singly or in combination.

In the embodiment shown, upper washing unit or drawer 16 is shown to include a front wall 20, rear wall (not shown), bottom wall 22 and opposing side walls 23 and 24 that collectively define a wash tub or basin 28. In a manner known in the art, basin 28 is provided with a dish rack 30 for supporting various objects, such as dishware, glassware, and the like, that are exposed to a washing operation. In a manner also known in the art, upper drawer 16 is slidingly supported within an outer body 4 through a pair of extensible support guides, one of which is indicated at 33. In addition, it should be understood that, although not shown, each drawer 16, 18 is provided with a corresponding lid member that selectively seals a respective basin 28. In any event, the above description is provided for the sake of completeness and to enable a better understanding of the drawings. The present invention is particularly directed to a dispenser, such as indicated at 43, for selectively storing and subsequently releasing detergent and/or rinse aid for a washing operation.

Figure 2:
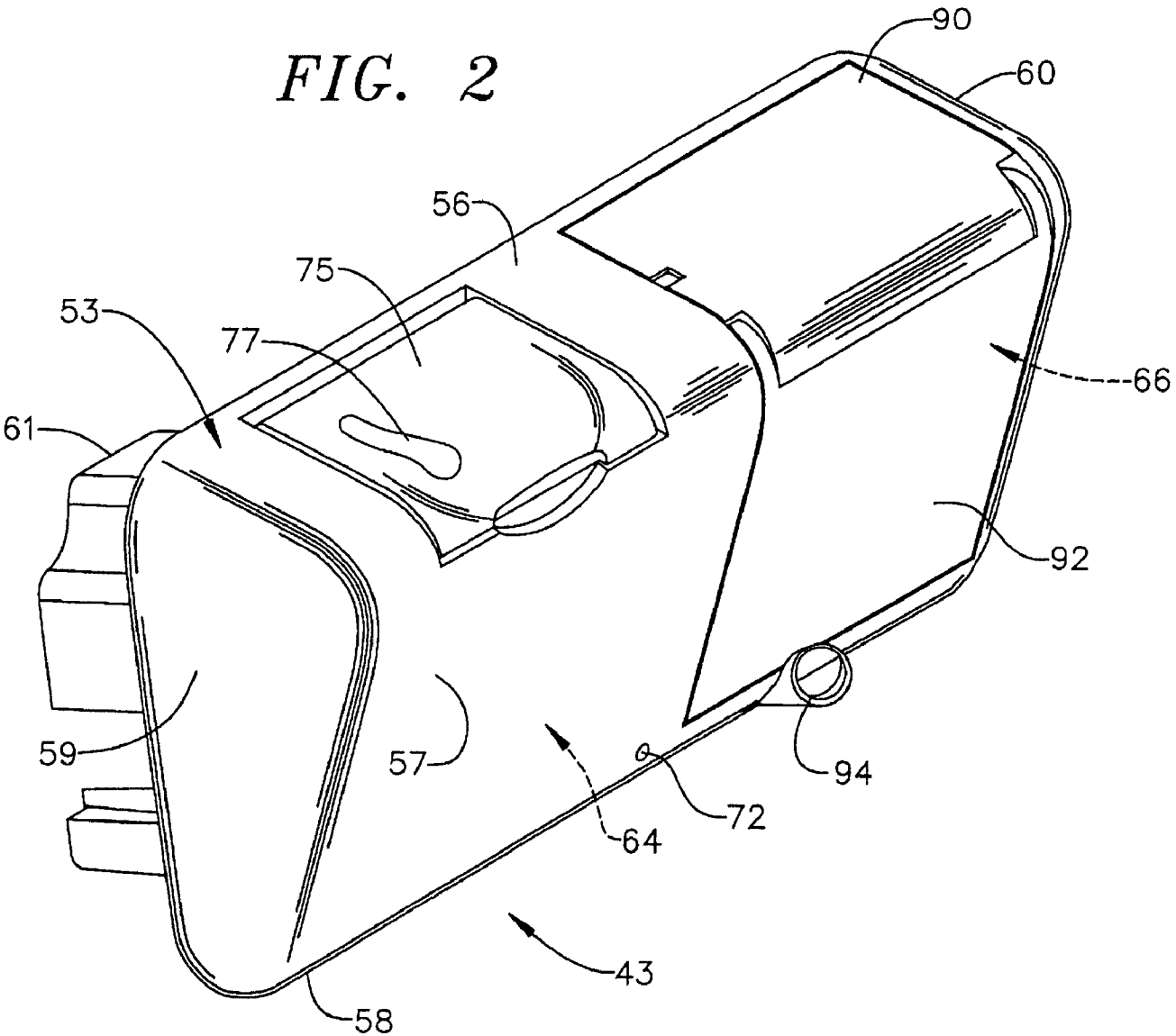
FIG. 2 is an enlarged upper left perspective view of the detergent dispenser of the present invention.
Figure 3A:
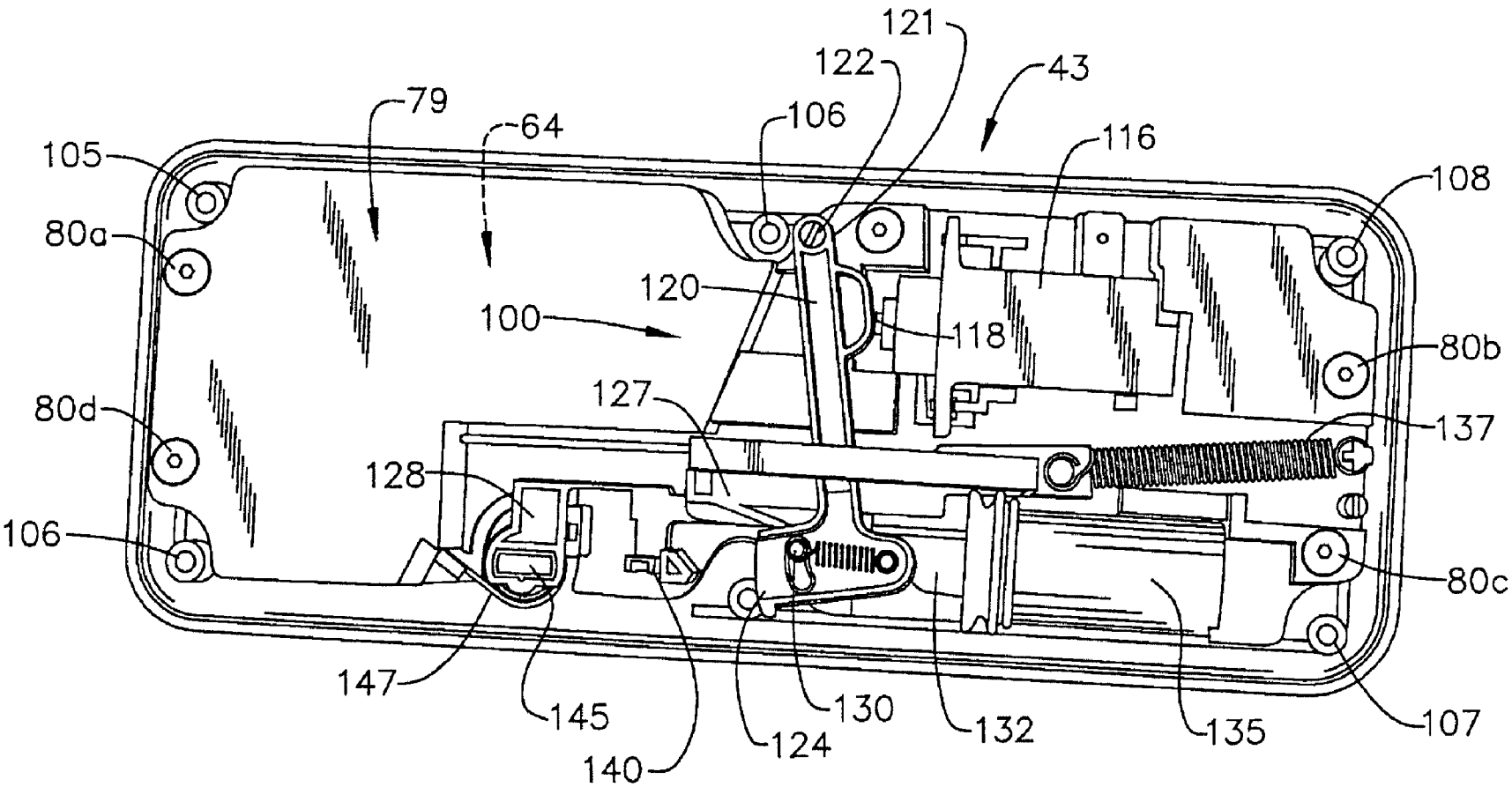
FIG. 3A is a rear elevational view of the detergent dispenser of FIG. 2 illustrating a dispensing mechanism in a first or home position.
Figure 3B:
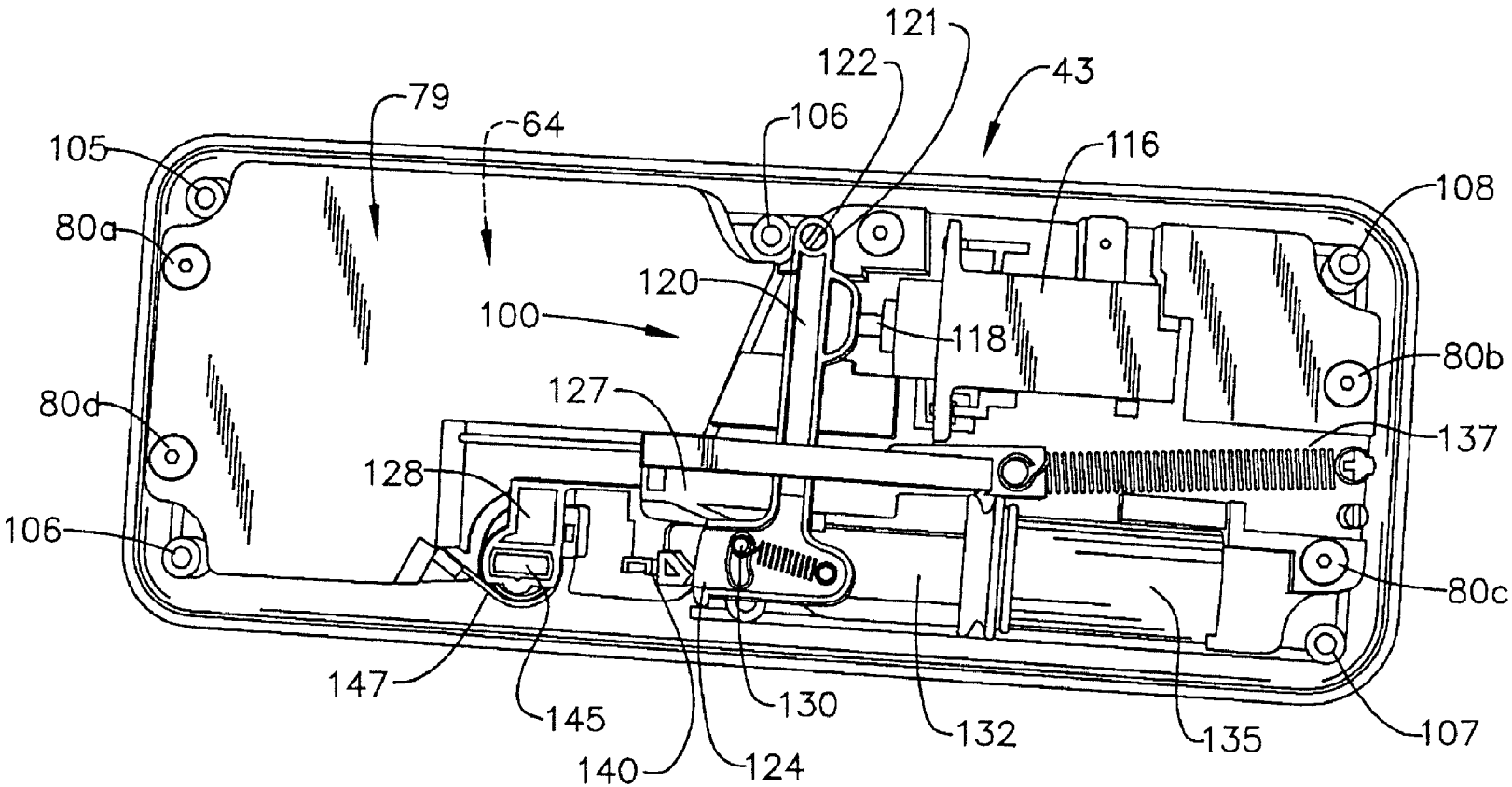
FIG. 3B is a rear elevational view of the detergent dispenser of FIG. 2 illustrating the dispensing mechanism in an intermediate position.
Figure 3C:
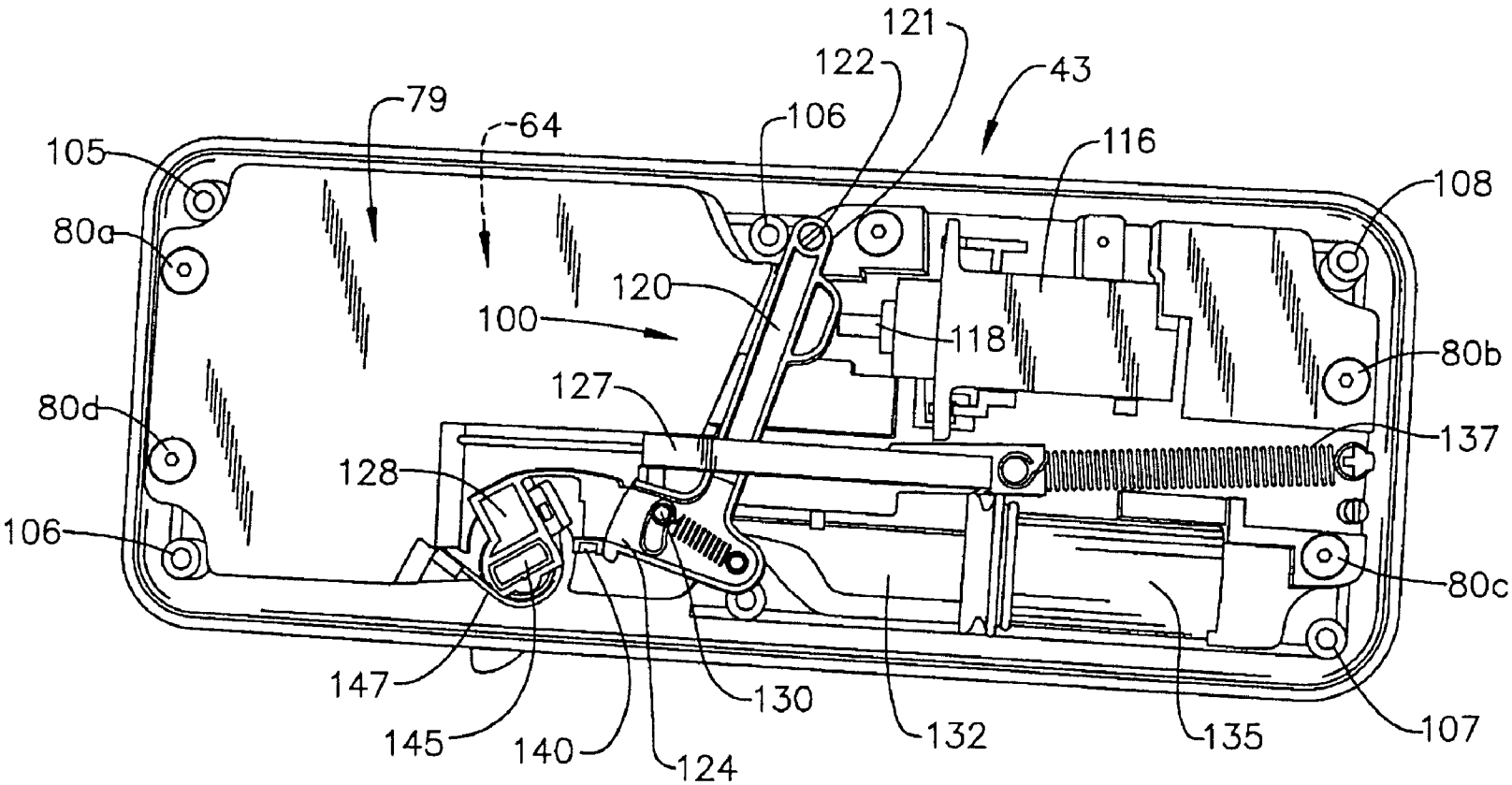
FIG. 3C a rear elevational view of the detergent dispenser of FIG. 2 illustrating the dispensing mechanism in a detergent release position.
Figure 4:
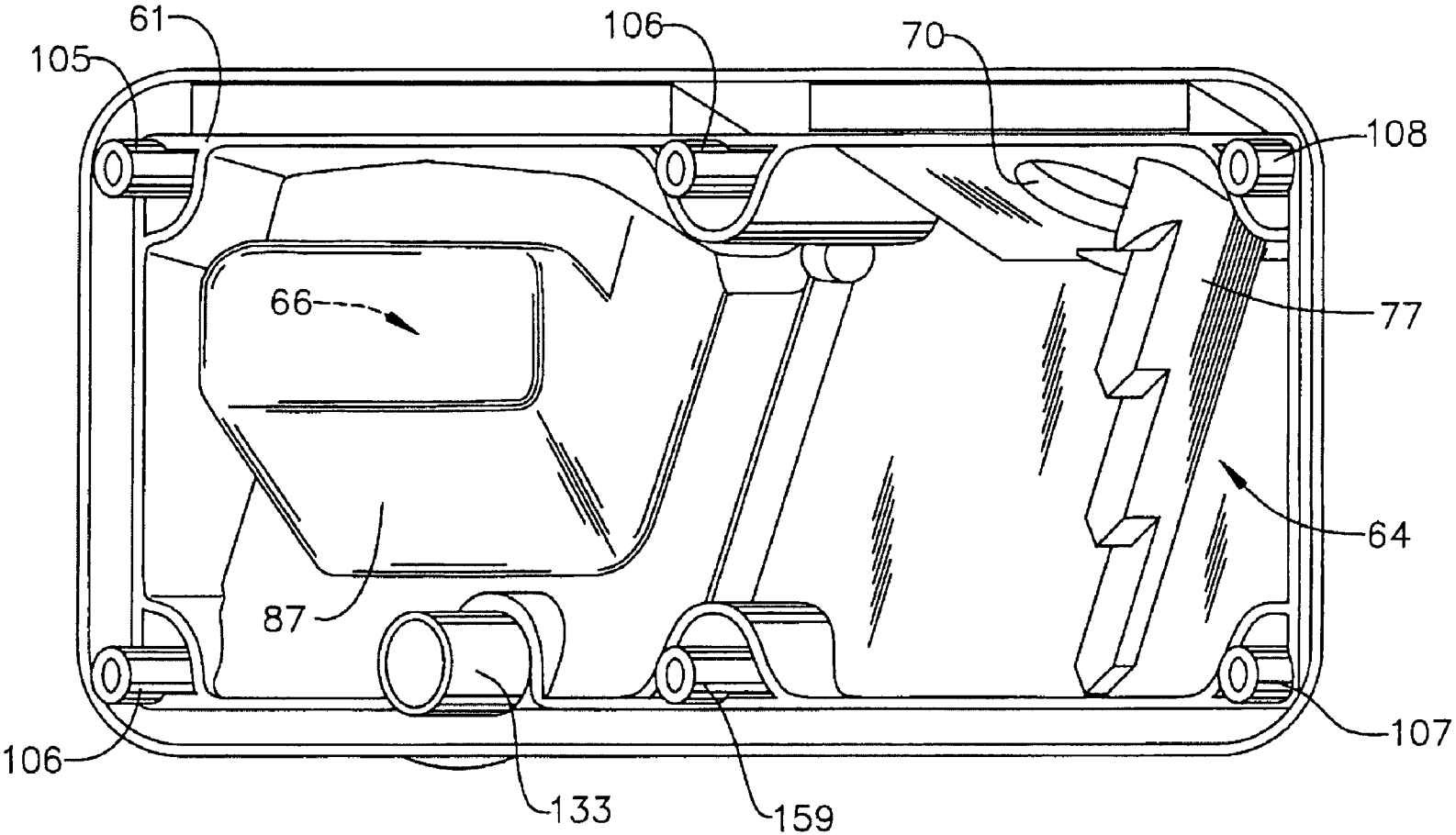
FIG. 4 is a rear elevational view of the dispenser of FIG. 3, shown with a backplate portion removed.

Referring to FIGS. 2-4, dispenser 43 includes a main body portion 53 having a top section 56, a front section 57, a bottom section 58, opposing side sections 59 and 60, and a rear section 61 that collectively define first and second reservoirs 64 and 66. In accordance with the invention, first reservoir 64 is designed to store a first wash aid, such as a rinse aid, while second reservoir 66 is designed to store a second wash aid, such as detergent. As shown, first reservoir 64 includes a first opening 70 (FIG. 4) for receiving the first wash aid and a second opening 72 that allows the first wash aid to pass into basin 28. First opening 70 is provided with a hinged cover 75 having a sight glass 77 that enables a consumer to determine a level of wash aid within first reservoir 64. Actually, first reservoir 64 is further defined by a rear cover 79 (FIG. 3) that is secured to rear section 61 through a plurality of fasteners 80*a*-80*d*.

Figure 5:
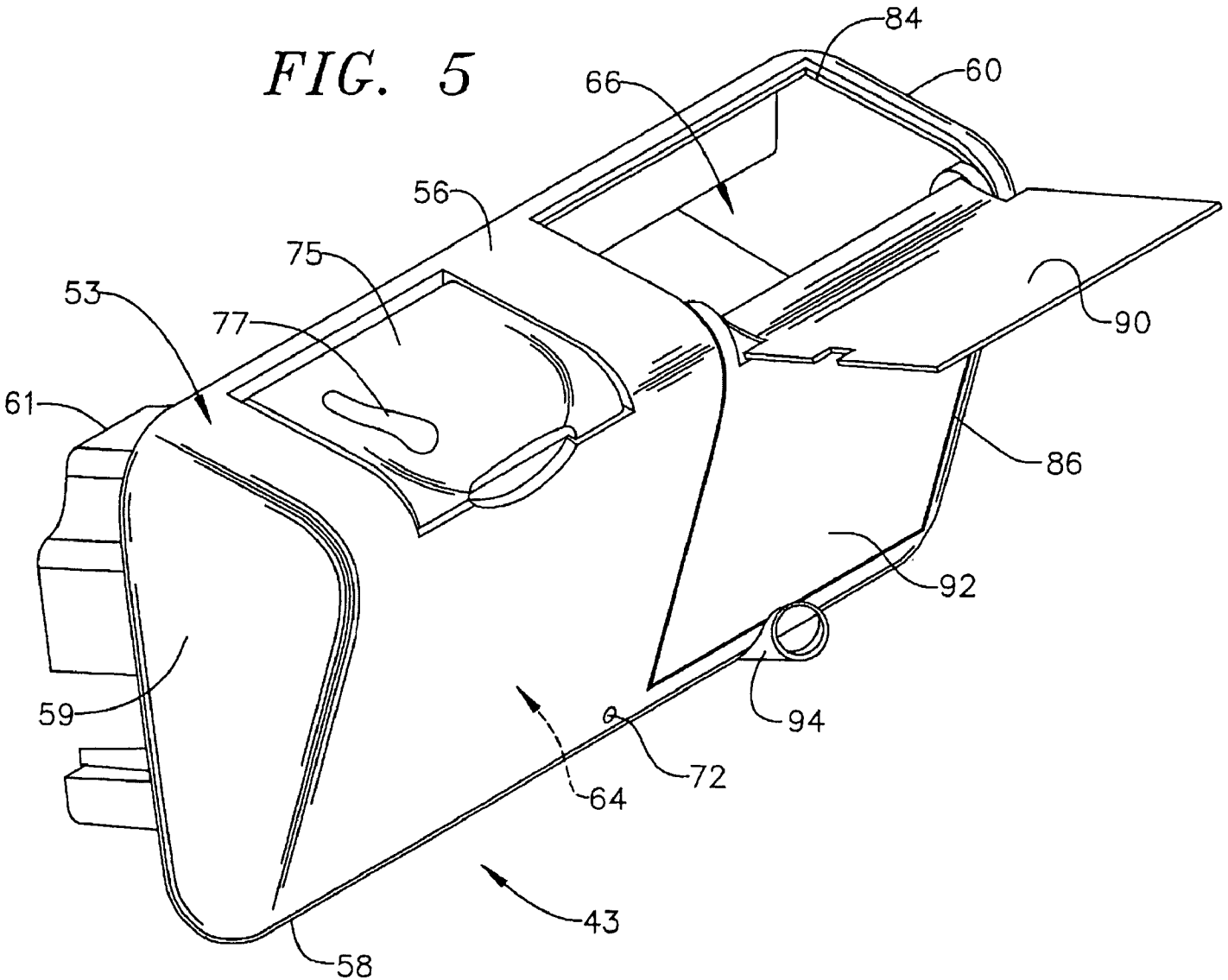
FIG. 5 is an upper perspective view of the detergent dispenser of FIG. 2 shown with a first lid in an open or loading configuration.
Figure 6:
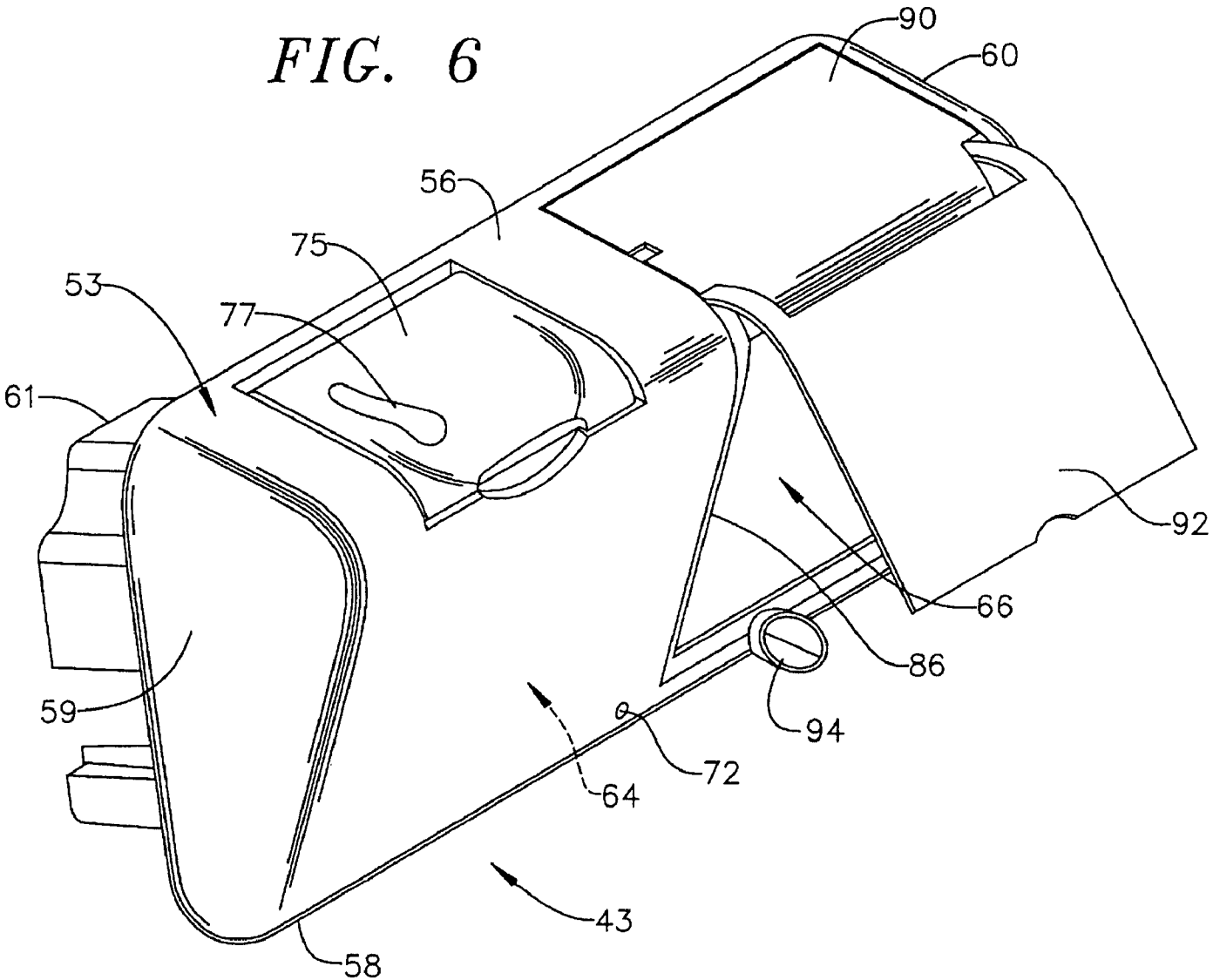
FIG. 6 is an upper perspective view of the detergent dispenser of FIG. 5 shown with a second lid in an open or dispensing configuration.

Second reservoir 66 includes a first opening 84 (FIG. 5) for receiving a second wash aid or detergent and a second opening 86 (FIGS. 5 and 6) that allows detergent to pass over an angled or chute portion 87 (FIG. 4) from second reservoir 66 into basin 28. In accordance with the invention, first opening 84 is located on top section 56 and second opening 86 is provided on front section 57. This arrangement allows a consumer to easily load detergent into second reservoir 66 through first opening 84, while the placement of second opening 86 on front section 57 allows gravity to dispense the detergent into basin 28 as will be discussed more fully below. In any case, first opening 84 is provided with a first door or lid 90, while second opening 86 is provided with a second door or lid 92. If desired, first lid 90 could be made to automatically open upon the closing of second lid 92 to enable a consumer to load detergent into dispenser 43 prior to initiating a wash operation. Second lid 92 can be opened either manually, through operation of a manual actuator or latch 94, or automatically as will be described more fully below.

In addition to manual actuator 94, dispenser 43 is provided with an automatic actuating system 100 arranged on rear section 61. Automatic actuating system 100 selectively opens second lid 92 during a wash operation. Preferably, automatic actuating system 100 is actually hidden when dispenser 43 is mounted to a wall of tub 28 to protect the various components from exposure to washing fluid. Towards that end, a plurality of mounting lugs 105-108 (FIGS. 3 and 4) are arranged on rear section 61. Mounting lugs 105-108 are adapted to receive mechanical fasteners (not shown) to secure dispenser 43 to, for example, front wall 20.

As best shown in FIGS. 3A-3C, automatic actuating system 100 includes a linear actuator 116, preferably a wax motor, having a plunger 118 that acts upon a pivotable lever 120. As shown, lever 120 includes a first end 121, pivotally mounted through a pin 122, that extends to a second end 124. Lever 120 is arranged so as to act upon a rinse aid charging lever 127 and a detergent door lever 128. More specifically, when acted upon by plunger 118, lever 120 moves from an initial or home position represented in FIG. 3A towards an intermediate position as represented in FIG. 3B. As lever 120 moves towards the intermediate position, a pin element 130 engages with charging lever 127 causing charging lever 127 to move a shaft 132 attached to a piston (not shown) to draw rinse aid from first reservoir 64 into a rinse aid cup 135. As charging lever 127 is shifted, a return spring 137 begins to load. At this point, lever 120 continues to rotate about pin 121 towards a detergent release position as presented in FIG. 3C.

In the detergent release position, charging lever 127 is fully extended, resulting in rinse aid cup 135 being charged or filled with a predetermined amount of rinse aid. At this point, it should be understood that the dispenser of the present invention could be employed to dispense only from second reservoir 66. That is, pin 130 could be manually shifted in a slot (not labeled) so that lever 120 does not engage with charging lever 127 but simply acts upon door release lever 145. In any case, as lever 120 moves towards the detergent release position, second end 124 contacts a post member 140 extending from detergent door lever 128. Continued movement of lever 120 causes detergent door lever 128 to rotate a door release lever 145 against a force applied by a torsion spring 147. Once door release lever 128 reaches a predetermined degree of rotation, second door 92 automatically opens to enable detergent to be released into basin 28.

After the detergent has been released into basin 28 and a washing portion of the dishwashing operation is completed, dishwasher 2 enters one or more rinse cycles. During the rinse cycle(s), clean, soap free water is directed onto the dishware to wash away any remaining detergent or soil particles. During at least one rinse cycle, if so desired, rinse aid is dispensed into basin 28. More specifically, during a rinse cycle, wax motor 116 is de-energized causing plunger 118 to retract, allowing return spring 137 to pull charging lever 127 to the home position of FIG. 3A. Charging lever 127 guides lever 120 back to the home position and urges the piston (not shown) into rinse aid cup 135. As the piston shifts into rinse aid cup 135, rinse aid is forced from rinse cup 135 and dispensed through opening 72 into basin 28. At this point, dispenser 43 is ready for subsequent washing operations. It should also be noted that, as lever 120 returns to the home position, torsion spring 147 rotates door release lever 145 in order to allow lid 92 to be closed for subsequent washing operations.

Although described with reference to a preferred embodiment of the invention, it should be readily understood that various changes and/or modifications can be made to the invention without departing from the spirit thereof. For instance, while the dispenser is shown to release detergent and/or rinse aid from a front portion, openings for this purpose could also be formed on side or even bottom portions of the dispenser. In general, the invention is only intended to be limited by the scope of the following claims.

I claim:

1. A dishwasher comprising:

an outer body;

a basin slidably supported by the outer body between an extended, loading/unloading position and a retracted, in use position, said basin including front, rear, bottom and opposing side walls that collectively define a wash chamber; and a dispenser assembly mounted to one of the front and opposing side walls of the basin, said dispenser assembly including:

a main body portion including at least a top section, a front section and a bottom section;

a first reservoir provided in the main body portion, said first reservoir including a first opening exposed at the top section for receiving a first wash aid, and a second opening for dispensing the first wash aid, said second opening leading to an outlet formed on one of the front and bottom sections;

a cover for selectively closing the first opening of the first reservoir;

a second reservoir provided in the main body portion, said second reservoir including a first opening exposed at one of the top and front sections for receiving a second wash aid, and a second opening exposed at one of the front and bottom sections for dispensing the second wash aid;

a first lid pivotally mounted relative to the main body portion for selectively covering the first opening of the second reservoir;

a second lid pivotally mounted relative to the main body portion for selectively covering the second opening of the second reservoir;

a rinse aid cup fluidly connected to the first reservoir; and an actuator mechanism for automatically releasing the first wash aid through the outlet, opening the second lid, and releasing the second wash aid from the second opening in the second reservoir during a wash operation, the actuator mechanism including a linear actuator, a pivoting lever, a charging lever and a door release lever, said pivoting lever being acted upon by the linear actuator and adapted to shift the charging lever and operate the door release lever, the rinse aid cup being operatively connected to the charging lever wherein, substantially simultaneous with the operation of the door release lever, the charging lever causes the first wash aid to enter the rinse aid cup and subsequently the charging lever causes the first wash aid to flow out of the rinse cup and through the outlet.

2. A dishwasher comprising:

an outer body;

a basin slidably supported by the outer body, said basin including front, rear, bottom and opposing side walls that collectively define a wash chamber; and a dispenser assembly mounted to one of the front and opposing side walls of the basin, said dispenser assembly including:

a main body portion including at least a top section, a front section and a bottom section;

a first reservoir provided in the main body portion, said first reservoir including a first opening exposed at one of the top and front sections for receiving a first wash aid and a second opening for dispensing the first wash aid, said second opening leading to an outlet formed on one of the front and bottom sections;

a second reservoir provided in the main body portion, said second reservoir including a first opening exposed at one of the top and front sections for receiving a second wash aid, and a second opening exposed at one of the front and bottom sections for dispensing the second wash aid;

a rinse aid cup fluidly connected to the first reservoir; and an actuator mechanism for automatically releasing the first wash aid through the outlet and releasing the second wash aid from the second opening in the second reservoir during a wash operation, the actuator mechanism including a linear actuator, a pivoting lever, a charging lever and a door release lever, said pivoting lever being acted upon by the linear actuator and adapted to shift the charging lever and operate the door release lever, the rinse aid cup being operatively connected to the charging lever wherein, substantially simultaneous with the operation of the door release lever, the charging lever causes the first wash aid to enter the rinse aid cup and subsequently the charging lever causes the first wash aid to flow out of the rinse cup and through the outlet.

3. The dishwasher according to claim 2, wherein the main body portion is mounted to the front wall of the basin.

4. The dishwasher according to claim 2, further comprising: a cover for selectively closing the first opening, said cover including a sight glass for providing a visual indication of a level of first wash aid present in the first reservoir.

5. The dishwasher according to claim 2, wherein the dispenser assembly further includes:

a first lid for selectively covering the first opening of the second reservoir; and a second lid for selectively covering the second opening of the second reservoir.

6. The dishwasher according to claim 5, wherein the actuator mechanism includes a linear actuator, a pivoting lever, a charging lever and a door release lever, said pivoting lever being acted upon by the linear actuator and adapted to shift the charging lever and operate the door release lever.

7. The dishwasher according to claim 6, wherein the rinse aid cup is operatively connected to the charging lever wherein, substantially simultaneous with the operation of the door release lever, the charging lever causes the first wash aid to enter the rinse aid cup.

8. The dishwasher according to claim 7, wherein the actuator mechanism includes a spring connected between the main body portion and the charging lever wherein, upon shifting of the linear actuator, said spring forces the charging lever towards the rinse aid cup to release the first wash aid into the wash chamber.

9. The dishwasher according to claim 2, further comprising: a return spring for biasing the charging lever to a home position.

10. The dishwasher according to claim 2, further comprising: a pin detachably connecting the pivoting lever to the charging lever, said pin positioned in a slot formed in the pivoting lever and being shiftable in the slot so that the pivoting lever does not engage the charging lever but only acts upon the door release lever.

11. A dishwasher comprising:

an outer body;

a basin slidably supported by the outer body, said basin including front, rear, bottom and opposing side walls that collectively define a wash chamber; and a dispenser assembly mounted to one of the front and opposing side walls of the basin, said dispenser assembly including:

a main body portion including at least a top section, a front section and a bottom section;

a reservoir provided in the main body portion, said reservoir including a first opening exposed at the top section for receiving a wash aid, and a second opening exposed at one of the front and bottom sections for dispensing the wash aid;

a first lid mounted relative to the main body portion for selectively covering the first opening of the reservoir;

a second lid mounted relative to the main body portion for selectively covering the second opening of the reservoir;

an actuator mechanism for opening the second lid and releasing the wash aid from the reservoir during a wash operation, the actuator mechanism including a linear actuator, a pivoting lever, a charging lever and a door release lever, said pivoting lever being acted upon by the linear actuator and adapted to shift the charging lever and operate the door release lever; and a rinse aid cup operatively connected to the charging lever for causing a rinse aid to enter the rinse aid cup.

12. The dishwasher according to claim 11, wherein the reservoir includes a chute portion, said chute portion guiding wash aid from the reservoir, through the second opening and into the wash chamber.

13. The dishwasher according to claim 11, wherein the dispenser assembly further includes a latch, said latch being operatively coupled to the actuator mechanism and the second lid, wherein said actuator mechanism is adapted to shift the latch to open the second lid and expose the reservoir.

14. The dishwasher according to claim 11, wherein the dispenser assembly further includes a reservoir for storing the rinse aid.

15. The dishwasher according to claim 11, wherein the charging lever, substantially simultaneous with the operation of the door release lever, causes the rinse aid to enter the rinse aid cup.

16. The dishwasher according to claim 11, wherein the actuator mechanism includes a spring connected between the main body portion and the charging lever wherein, upon shifting of the linear actuator, said spring forces the charging lever towards the rinse aid cup to release the rinse aid into the wash chamber.

17. The dishwasher according to claim 11, further comprising: a return spring for biasing the charging lever to a home position.

18. The dishwasher according to claim 11, further comprising: a pin detachably connecting the pivoting lever to the charging lever, said pin positioned in a slot formed in the pivoting lever and being shiftable in the slot so that the pivoting lever does not engage the charging lever but only acts upon the door release lever.

* * * * *